US006652437B1

(12) United States Patent
Bergeron et al.

(10) Patent No.: US 6,652,437 B1
(45) Date of Patent: Nov. 25, 2003

(54) ACTUATED PRODUCT SEIZING ELEMENT IN A FOLDER APPARATUS

(75) Inventors: Eugene John Bergeron, Barrington, NH (US); David Elliot Whitten, Barrington, NH (US); Christopher John Slusarz, Lebanon, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/473,813

(22) Filed: Dec. 28, 1999

(51) Int. Cl.[7] ..... B31F 1/00

(52) U.S. Cl. ..... 493/432; 74/567; 101/409

(58) Field of Search ..... 493/397, 403, 493/432, 442; 83/409, 410, 410.7; 74/567–569, 55–57; 101/409, 415.1

(56) References Cited

U.S. PATENT DOCUMENTS

| | | | | | |
|---|---|---|---|---|---|
| 3,731,545 | A | * | 5/1973 | Beezer | 74/24 |
| 3,961,783 | A | | 6/1976 | Beaudoin | 270/66 |
| 3,975,975 | A | * | 8/1976 | Giulie et al. | 83/410 |
| 3,999,454 | A | | 12/1976 | Tiso et al. | 83/107 |
| 4,100,841 | A | * | 7/1978 | Amberg | 493/371 |
| 4,564,183 | A | | 1/1986 | Mueller | 270/21.1 |
| 4,610,652 | A | * | 9/1986 | Henn et al. | 493/432 |
| 4,790,804 | A | * | 12/1988 | Gotou et al. | 493/226 |
| 4,856,378 | A | * | 8/1989 | Hvolka | 475/168 |
| 5,249,916 | A | * | 10/1993 | Portrait et al. | 414/798.9 |
| 5,259,877 | A | * | 11/1993 | Ozaki | 118/53 |
| 5,284,466 | A | * | 2/1994 | Magnusson et al. | 493/385 |
| 5,337,623 | A | * | 8/1994 | Huang et al. | 74/813 R |
| 5,484,379 | A | | 1/1996 | Stäb | 493/359 |
| 5,503,071 | A | | 4/1996 | Hillebrand et al. | 101/409 |
| 5,547,452 | A | | 8/1996 | Kepert et al. | 493/427 |
| 6,165,118 | A | * | 12/2000 | Eckert | 493/425 |
| 6,382,038 | B2 | * | 5/2002 | Angeles et al. | 74/84 R |
| 2002/0035881 | A1 | * | 3/2002 | Kato | 74/53 |

FOREIGN PATENT DOCUMENTS

| | | | | |
|---|---|---|---|---|
| DE | 4446753 | | 12/1995 | |
| EP | 0931748 | | 7/1999 | |
| JP | 6-109093 | * | 6/1994 | 74/53 |

* cited by examiner

*Primary Examiner*—Stephen F. Gerrity
*Assistant Examiner*—John Paradiso
(74) *Attorney, Agent, or Firm*—Davidson, Davidson & Kappel, LLC

(57) ABSTRACT

The present invention is related to a paper conducting cylinder (8) of a folder assembly (1). A cylinder surface (18) has a plurality of counterparts (23) for cooperation with cutting elements of a cutting cylinder (3). Product seizing element (24) being assigned to said paper conducting cylinder circumference (18) are located adjacent to said counterpart (23) and said cylinders (8) surface (18). Said product seizing element (24) perform an extending movement about a first pivot point (25) and a seizing movement about a further pivot point (26).

12 Claims, 4 Drawing Sheets

ACTUATED PRODUCT SEIZING ELEMENT IN A FOLDER APPARATUS

BACKGROUND INFORMATION

1. Field of the Invention

The present invention is related to a product seizing element in a folder apparatus, having at least one folding cylinder the surface of which forwards products along a respective product travel pass.

2. Background of the Invention

U.S. Pat. No. 5,484,379 discloses a folder assembly for printing presses. A folder assigned to a web-fed rotary printing press includes a pair of cooperating collecting and cutting cylinders to sever a web of paper into web segments. A belt conveyor system enwraps a portion of the surface of the collecting cylinder just before an intake point of paper ribbon between the collecting cylinder and the cutting cylinder. This belt conveyor system prevents the newly created leading edge of the paper ribbon from springing back.

According to the solution of U.S. Pat. No. 5,484,379 a belt conveyor system is arranged adjacent to said collecting cylinder. Said belt conveyor system contacts a leading edge portion of the web of material disposed on the preferred surface of said collecting cylinder. Said belt conveyor system imparts on said leading edge of the web of material in a direction of paper web travel. Thus, said collecting cylinder and said belt conveyor system impart a prestress in said direction of paper web travel of said leading edge with respect to the cylinders surface. By prestressing of said leading edge of said web of material with respect to the cylinders surface the leading edge is forced to slip on the respective cylinders surface. Depending upon the paper stock, the number of ribbons included in the respective web of material, the accuracy of folds to be performed in the later stages depends upon the position in which said newly created lead edge of the web of material is seized by respective seizing elements.

SUMMARY OF THE INVENTION

In view of the technical problems encountered in the solution according to the prior art, it is an object of the present invention, to provide for a secure seizing of the new leading edge of the web of material from which respective products are severed without interference of the seizing elements with the cutting operation.

A further additional or alternate object of the present invention is to provide for a motion of seizing elements of said lead edge of the web of material by reliable elements.

A still further additional or alternate object of the present invention is to allow for positive control of the respective products severed from the incoming web of material.

According to an examplary embodiment of the present invention, a paper conducting cylinder of a folder assembly includes:

A cylinder surface having counterparts for cooperation with cutting elements of a cutting cylinder, product seizing elements assigned to said counterparts on said cylinder's surface, said product seizing elements performing an extending movement about a first pivot axis and said product seizing elements performing a seizing movement about a further pivot axis.

The advantages of the solution according to the present invention are given by the fact that said leading edge portion of the web of material is not subject to a relative movement with respect to the paper conducting cylinder surface. Thus, no misregistration within a leading edge of a web of material comprising a plurality of ribbons occurs. Still further, a motion is imposed on a respective seizing element in a two-step-manner, to allow for an extending movement after the cutting action has resulted in a cut in a first step and then to allow for a seizing motion of a head portion of a seizing element from an upward opened, extended position into a downward directed seizing motion in a second step.

In further advantageous embodiments of the present invention said seizing elements comprise a first and second portion, respectively. Said second portion has an inclined hook-shaped portion to seize a respective leading edge of a web of material. Said leading edge may have a number of layers or ribbons, respectively, to be reliably secured by said seizing element without imposing a relative movement on to said leading edge of the web of material when arranged upon the paper conducting cylinder's surface. Said product seizing elements are arranged on the circumference of said paper conducting cylinder, assigned to each of respective cutting counterparts on said cylinder surface for the respective cutting operations. For an actuation of said product seizing element on the cylinder surface a plurality of actuating elements are provided to impose a two-step-motion on said respective seizing elements.

Said actuating elements comprise a cam element which may be shaped as a double track cam, having a respective first track and a respective second track. Said tracks include first and second profiles each having low and high dwell-sections, respectively. Said profiles of the respective tracks are the respective cam surfaces cooperating with respective actuating elements such as cam followers of said seizing elements.

Said actuating elements include a fixed pivot axis to which said product seizing element is fastened. Between said fixed pivot axis and said product seizing element a linking element such as a lever or like is mounted. A further actuating element, cooperating with one of said tracks of said double track cam rotates via a link member about a respective secondary pivot axis. Thus, when said second actuating element will rotate via a link member said rotating movement about its secondary pivot axis to extend said seizing element into an extended position about the respective cylinder surface.

Said secondary pivot axis corresponds to a first cam follower cooperating with said previously mentioned first cam profile. In following said first cam profile said first cam follower will be lifted into an extended position moving said product seizing element into an extended position beyond said respective portion of the paper-conducting cylinder surface. Followed by a second actuating element following the respective cam on the respective second track said seizing element being in an extended position will be rotated from its upward position about a secondary pivot axis into a downwardly directed motion a seizing motion thus seizing the respective leading edge of a web of material without imposing a relative movement on to said leading edge of said web of material.

A paper conducting cylinder having a dual-operated-seizing element according to the above mentioned description is advantageously used in a folder apparatus for commercial and newspaper applications.

According to a method of operating a product seizing element a respective product seizing element assigned to the paper conducting cylinders surface extends from a retracted position into an extended position beyond said cylinders surface in a first actuating step and in a second actuating step said product seizing element is moved from an extended position in a downwardly directed movement towards said leading edge position on said paper conducting cylinder surface. Said extending movement step and the seizing movement step performed in a substantially downwardly directed manner will follow each other subsequently for a seizing action without interference with the cutting operation. Said first step describing an extending movement of said product seizing element first portion will move said product seizing element's first portion into an upward position. Upon actuation of said second actuating element such as a cam follower said product seizing element being in an extended position is moved in a substantially downwardly directed manner to seize the respective multi-layered ribbon of the respective web of material on the surface of the paper conducting cylinder. The respective downwardly directed movement of said product seizing elements first portion towards the paper conducting cylinders surface eliminates any relative movement of said leading edge since said cut leading edge is seized substantially in its registered position in the vicinity of said groove within which said cutting counterparts such as anvil bars are received on the respective paper-conducting cylinder surface.

BRIEF DESCRIPTION OF THE DRAWINGS

The novel features which are considered characteristic for the invention are set forth in particular in the appended claims. The invention itself, however, both as to its construction and its method of operation together with additional objects and advantages thereof, will be best understood from the following description of a specific embodiment when read in connection with the accompanying drawings, in which:

DETAILED DESCRIPTION OF PREFERRED EMBODIMENTS

Figure 1:
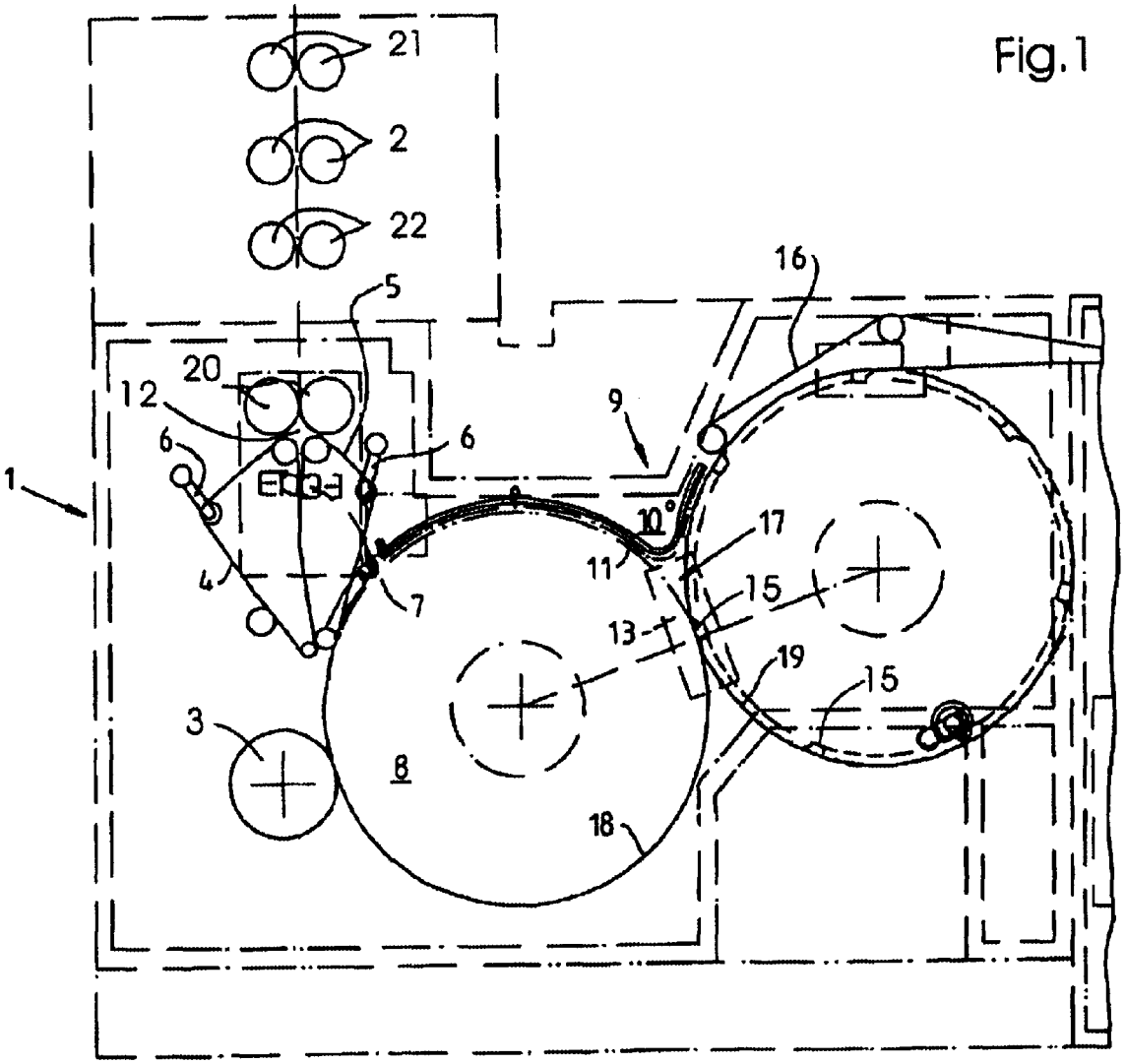
FIG. 1 is a side elevation of a folder assembly.

According to FIG. 1, a side elevation of a folder assembly is given in greater detail.

FIG. 1 shows a general side view of an exemplary embodiment of a folding apparatus 1 according to the present invention wherein a folding cylinder scheme and a path of product-transporting conveying means within the folder are illustrated. In a frame of a folding apparatus 1, there is arranged a cutting cylinder 3 comprising a knife and cooperating with counterparts on the surface of a respective first paper-conducting cylinder 8. Perforating units represented as cross-perforating cylinders 2 can also be included to cross-perforated web material before it is severed into products or signatures. The web material is transported by nip rollers 21 through the perforating cylinders 2 and through seizing rollers 22 to the cutting cylinder 3. A transport system is provided with first and second conveying tapes 4, 5, respectively. Assigned to the conveying tapes 4, 5 there are tape tensioning devices 6, 6'. Integrated into the conveying path of the tapes 4, 5 are combing rollers 7 which smooth the product as it is transported are provided.

Through conveying tapes 4, 5, respectively, products are conveyed to a first paper-conducting cylinder 8. The products then are conveyed in a counter clockwise direction to a fold of area 13 at a nip between the collecting cylinder 8 and a folding or jaw cylinder 14. Through belt 4, the products are conveyed to a surface 18 of the collecting cylinder 8 through an entering section 12 having each product under positive control. Having reached the fold off area 13 the products are tucked by tucker blades—which are not shown in greater detail—into folding jaws 15 arranged on a circumference 19 of a second product-conducting cylinder 14.

A transversal fold is, in an examplary embodiment performed at the middle of a product (that is, at a product mid-point), when one half of the length of the product to be transfered and cross folded has reached the circumferential section below a product-guiding device 9, having a smoothing element 11. Upon tucking one half of the product into a corresponding jaw 15 of the jaw cylinder 14, an upper half of the product travels in a counter clockwise direction on the cylinder's surface 18 of the first paper conducting cylinder 8 or collecting cylinder, while the lower half of the product follows the second paper-conducting 14 in a clockwise direction. The product is pulled by the jaw cylinder 14 to leave the collecting cylinder 8 in a clockwise direction below a smoothing element 11, which extends in a clockwise direction. Within a transfer area 17, the product is subjected to high forces of acceleration, resulting in a whipping effect of the product edges. The guiding device 9, having the smoothing element 11, is afixed to a respective shield which is mounted within the folding apparatus.

Figure 2:
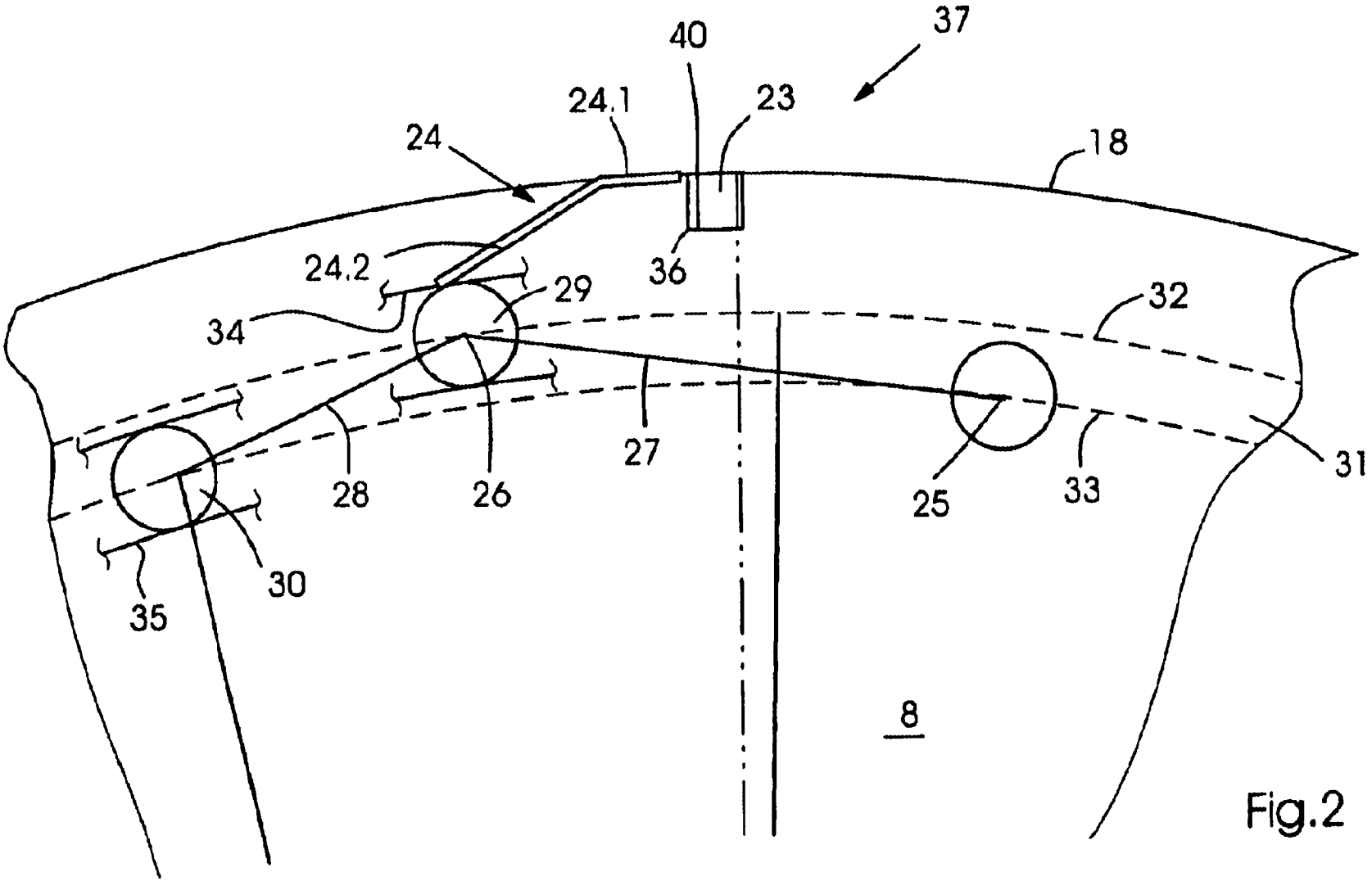
FIG. 2 shows a product seizing element in its respective retracted position to allow for a cutting operation.

FIG. 2 shows a product seizing element in its respective retracted position to allow for a cutting operation.

In a respective starting position 37, a dual-operated-product seizing element 24 is shown in its retracted position. Along a respective circumference 18 of a first paper-conducting cylinder 8, a plurality of product seizing elements 24 corresponding to the number of cutting counterparts 23 are arranged. The product seizing elements 24, each comprise a first portion 24.1 and a second hook-shaped portion 24.2, respectively. Assigned to a respective first paper conducting cylinder 8, is an actuating cam 31 which is shown here as a double track cam having two respective cam tracks 34, 35 respectively. On the other hand said actuating cam may include 2 independently phaseable cams each having respective tracks 34, 35. Through two independent cams 34, 35 an independent phasing of the respective two-step-movement of the product seizing element 24 can be adjusted independently. Said two cam tracks 34, 35 respectively each comprise a first and a second profile 32, 33 respectively. As will be described in greater detail below, said profiles 32, 34, respectively each comprise high dwell and low dwell portions for initializing the respective actuating periods of said plurality of product seizing element 24.

Said product seizing element 24 is fastened with its first portion 24.1 with respect to a secondary pivot axis 26. Co-axially to said secondary pivot axis 26 an actuating element 29 such as a cam follower 29 is mounted rotatably. From said secondary pivot axis 26 to respective linking members 27, 28 extend to a first pivot fixed 25 and to a second actuating element 30, such as a cam follower following the profile of the respective second cam track 35. On the respective cylinder surface 18 of said first paper conducting cylinder 8 a groove 36 is shown receiving said counterpart 23—such as an anvil bar—with which the respective knives of the cutting cyliner 3 according to FIG. 1 cooperate upon a cutting operation.

Figure 3:
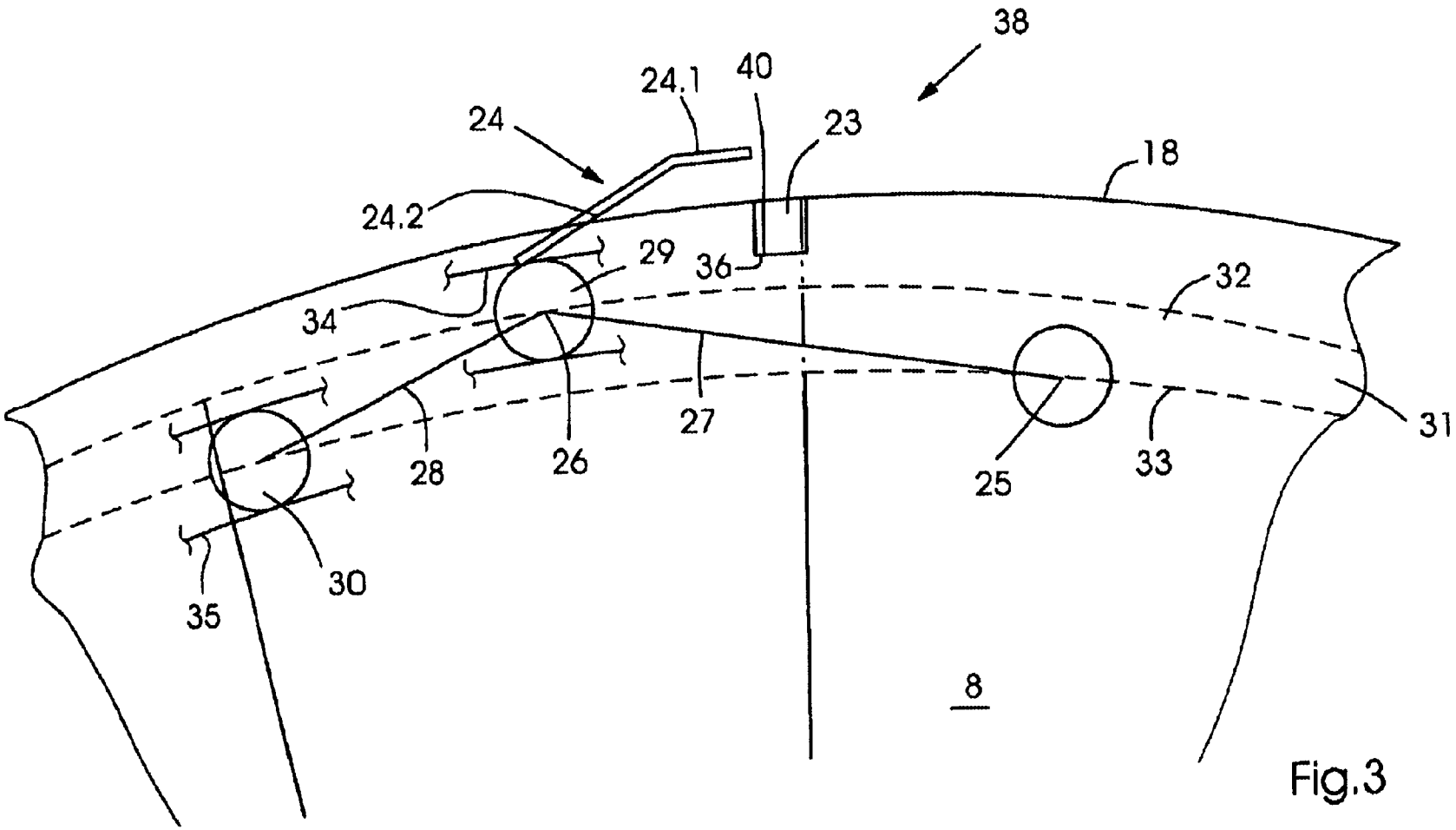
FIG. 3 shows said product seizing element in its respective intermediate position extended above the paper conducting cylinders surface and FIG. 4 shows said product seizing element in its respective closed position having seized a respective leading edge of a web of material.

FIG. 3 shows said product seizing element in its respective intermediate position extended above paper conducting cylinder's surface.

According to this configuration said secondary pivot axis 26 is moved by the first cam profile 32 of the first track 34 into an upward position. In the position of the secondary pivot axis 26 may be moved in its upward position by the respective high dwell portion by slight rotation about said fixed pivot 25. As schematically given here said actuating element 29 on which said seizing element 24 is mounted is extended by cam follower 29 following the respective first track 34 of said cam 31. The degree of opening of said seizing element 24 said seizing element's 24 first portion 24.1 relative to a respective lead edge portion 40 may be varied by phasing of the cam tracks 34, 35 with respect to one another.

By having the respective second actuating element 30 passing said second cam profile 33 in a low dwell portion, said linking member 28 moves said secondary pivot 29 in counter-clockwise direction providing for a high degree of opening of the seizing element 24. Thus, thicker leading edges of webs of materials can be accurately seized since all of the ribbon layers will be seized in a downwardly directed motion of the respective first portion 24.1 of the respective seizing element 24 at once. The motion of the respective seizing element 24 shown in FIG. 3 corresponds to the first step, i.e. an intermediate position 38 of the seizing element 24. In this stage, the respective seizing element 24 has just opened according to a predetermined degree depending upon the thickness of the leading edge of the web of material to be processed in the folder apparatus 1 according to the present invention.

Figure 4:
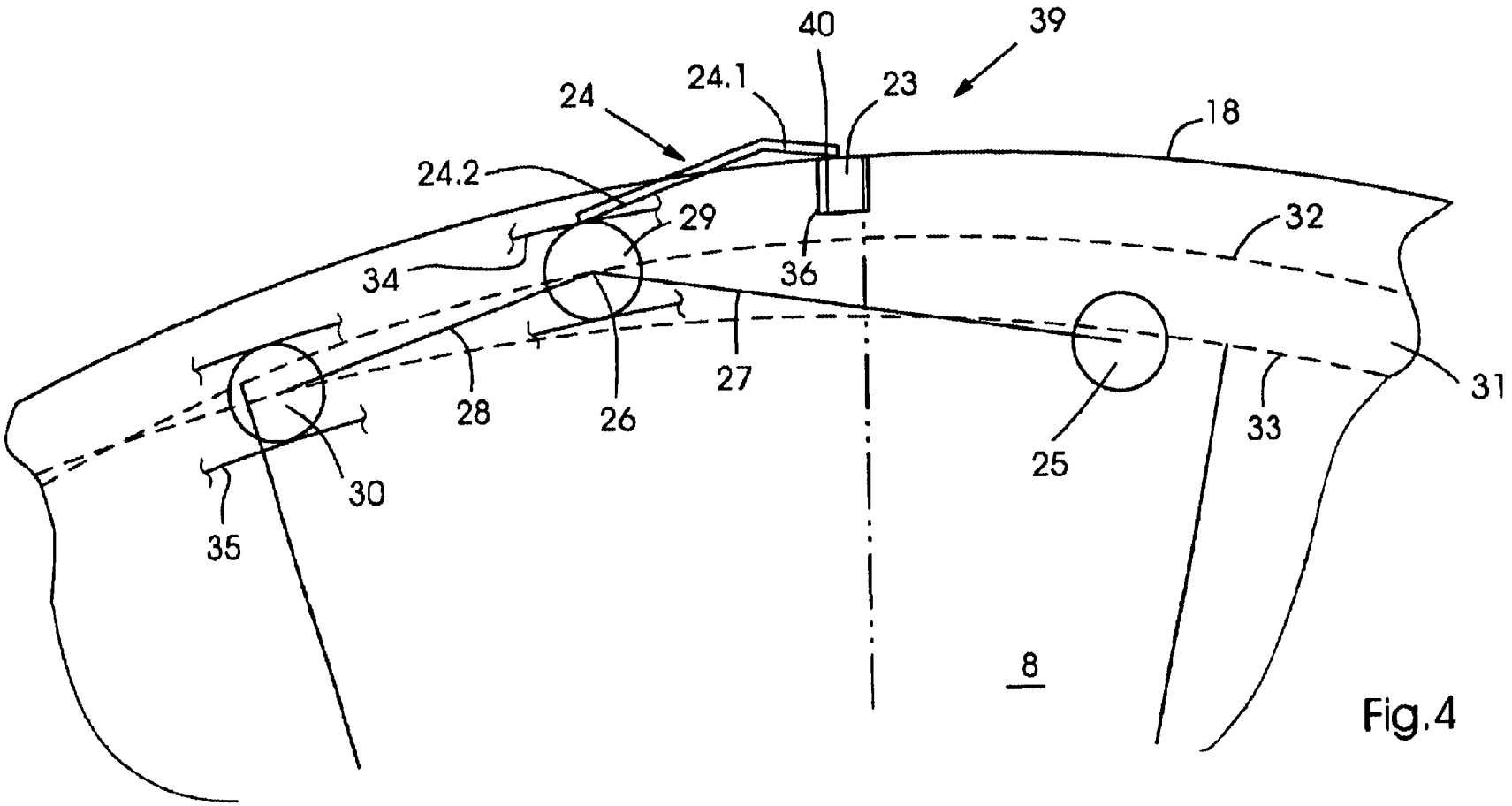

FIG. 4 shows said product seizing element in its respective closed position having seized a respective leading edge of a web of material.

In following upside intermediate position 38 as given in previously described FIG. 3 said product seizing element 24 now adopts a closed position 39 with respect to the leading edges position 40. The respective secondary pivot axis 26 and accordingly said actuating said second actuating element 29 being moved in its upward position, the second movement step, i.e. the closing of product seizing element 24 is achieved by the second actuating element 30 contacting a high dwell position of the respective second track 35 having a second cam profile 33. Via a second linking member 28 said secondary pivot axis 26 will be rotated in clockwise direction, thus causing said product seizing element 24 to move substantially downwards contacting a respective leading edge of a web of material above said leading edge position, indicated by reference numeral 40. Depending upon the high dwell position of said first track 34 and the respective low dwell position of said second track 35, the degree of opening of the seizing element 24 is determined and adjustable. On the other hand by the respective high dwell position of the second track 35, the extent to which the hook-shaped first portion 24.1 of the product seizing element 24 is moved downwards with respect to the leading edge of the web can be varied. By phasing of two independently adjustable cam tracks 34, 35 with respect to one another the extent of closing and the amount of the seizing force exerted upon the respective leading edge can be adjusted individually according to print job requirements.

The dual-action-seizing can be performed—although not shown here in greater detail—by actuation of said seizing element 24 via electric actuators such as electric motors. The product seizing element 24 according to the present invention are used in folders on respective paper-conducting cylinders, such as collecting cylinders, folding cylinders and/or jaw cylinders.

REFERENCE NUMERAL LIST

1 folder apparatus
2 perforating cylinders
3 cutting cylinder
4 conveying tapes
5 conveying tapes
6 tape tensioning means
7 combing rollers
8 first paper conducting cylinder
9 product guide
10 shield
11 smoothing element
12 rollers
13 fold-off area
14 second paper conducting cylinder
15 folding jaws
16 conveying tape
17 transfer area
18 cylinder surface
19 circumference
20 second perforating cylinders
21 nip rollers
22 seizing rollers
23 bars
24 seizing element
24.1 first portion
24.2 second portion
25 fixed pivot
26 secondary pivot
27 first linking member
28 second linking member
29 first cam follower
30 second cam follower

31 double track cam
32 first cam profile
33 second cam profile
34 first track
35 second track
36 groove
37 starting position
38 intermediate position
39 closing position
40 lead edge position

What is claimed is:

1. A paper conducting cylinder of a folder assembly comprising:

a cylinder surface having counterparts for cooperation with cutting elements of a cutting cylinder;

product seizing elements assigned located next to the counterparts on the cylinder surface;

a first actuating element connected to the product seizing elements;

a first linking member coupled to the first actuating element and to a first fixed pivot;

a second linking member; and a second actuating element coupled to the first actuating member via the second link member, the first actuating element following a first track and the second actuating member following a second track.

2. The paper conducting cylinder according to claim 1, wherein said product seizing elements comprise a first portion and a second portion angled with respect to the first portion.

3. The paper conducting cylinder according to claim 1, wherein a number of product seizing elements correspond to a number of counterparts assigned to the cylinder surface.

4. The paper conducting cylinder according to claim 1, wherein said first and second actuating elements each comprise a cam follower.

5. The paper conducting cylinder according to claim 4, wherein said cam followers follow in a double track cam having the first track and the second track.

6. The paper conducting cylinder according to claim 5, wherein said double track cam comprises first track elements and second track elements having different paths.

7. The paper conducting cylinder according to claim 4, wherein said first track and said second track include a first cam profile and a second cam profile, respectively.

8. The paper conducting cylinder according to claim 7, wherein said first cam profile generates the extending motion of said seizing element with respect to said cylinder surface.

9. The paper conducting cylinder according to claim 4, wherein said first track and said second track have respective high dwell portions and respective low dwell portions on respective outer contours.

10. The paper conducting cylinder according to claim 1, wherein the first actuating element is rotatably connected about the first fixed pivot.

11. The paper conducting cylinder according to claim 10, wherein said seizing element is moved about a secondary pivot axis by the second actuating element.

12. The paper conducting cylinder according to claim 11, wherein said secondary pivot axis corresponds to a first cam follower.

* * * * *

US006652437C1

(12) EX PARTE REEXAMINATION CERTIFICATE (6183rd)

United States Patent
Bergeron et al.

(10) Number: US 6,652,437 C1
(45) Certificate Issued: Apr. 8, 2008

(54) ACTUATED PRODUCT SEIZING ELEMENT IN A FOLDER APPARATUS

(75) Inventors: Eugene John Bergeron, Barrington, NH (US); David Elliot Whitten, Barrington, NH (US); Christopher John Slusarz, Lebanon, ME (US)

(73) Assignee: Goss International Americas, Inc., Dover, NH (US)

Reexamination Request:
No. 90/007,262, Oct. 21, 2004

Reexamination Certificate for:

| | |
|---|---|
| Patent No.: | **6,652,437** |
| Issued: | **Nov. 25, 2003** |
| Appl. No.: | **09/473,813** |
| Filed: | **Dec. 28, 1999** |

(51) Int. Cl.
*B31F 1/00* (2006.01)

(52) U.S. Cl. ..... 493/432; 74/567; 101/409

(58) Field of Classification Search ..... 493/353, 493/397, 403, 426, 432, 442; 83/409, 410, 83/410.7; 74/567, 568, 569, 55, 56, 57; 101/409, 101/415.1
See application file for complete search history.

(56) References Cited

U.S. PATENT DOCUMENTS

| | | | |
|---|---|---|---|
| 953,063 | A | 3/1910 | Sheldon |
| 3,731,545 | A | 5/1973 | Beezer |
| 3,961,783 | A | 6/1976 | Beaudoin |
| 3,975,975 | A | 8/1976 | Giulie et al. |
| 3,999,454 | A | 12/1976 | Tiso et al. |
| 4,100,841 | A | 7/1978 | Amberg |
| 4,564,183 | A | 1/1986 | Muller |
| 4,610,652 | A | 9/1986 | Henn et al. |
| 4,790,804 | A | 12/1988 | Gotou et al. |
| 4,856,378 | A | 8/1989 | Hvolka |
| 5,249,916 | A | 10/1993 | Portrait et al. |
| 5,259,877 | A | 11/1993 | Ozaki |
| 5,284,466 | A | 2/1994 | Magnusson et al. |
| 5,337,623 | A | 8/1994 | Huang et al. |
| 5,484,379 | A | 1/1996 | Stab |
| 5,503,071 | A | 4/1996 | Hillebrand et al. |
| 5,547,452 | A | 8/1996 | Kepert et al. |
| 6,093,139 | A | 7/2000 | Belanger |
| 6,165,118 | A | 12/2000 | Eckert |
| 6,382,038 | B2 | 5/2002 | Angeles et al. |
| 2002/0035881 | A1 | 3/2002 | Kato |

FOREIGN PATENT DOCUMENTS

| | | |
|---|---|---|
| DE | 44 46 753 A1 | 12/1995 |
| EP | 0 931 748 B1 | 7/2002 |
| JP | 06-109093 | 4/1994 |

*Primary Examiner*—Louis Huynh

(57) ABSTRACT

The present invention is related to a paper conducting cylinder (8) of a folder assembly (1). A cylinder surface (18) has a plurality of counterparts (23) for cooperation with cutting elements of a cutting cylinder (3). Product seizing element (24) being assigned to said paper conducting cylinder circumference (18) are located adjacent to said counterpart (23) and said cylinders (8) surface (18). Said product seizing element (24) perform an extending movement about a first pivot point (25) and a seizing movement about a further pivot point (26).

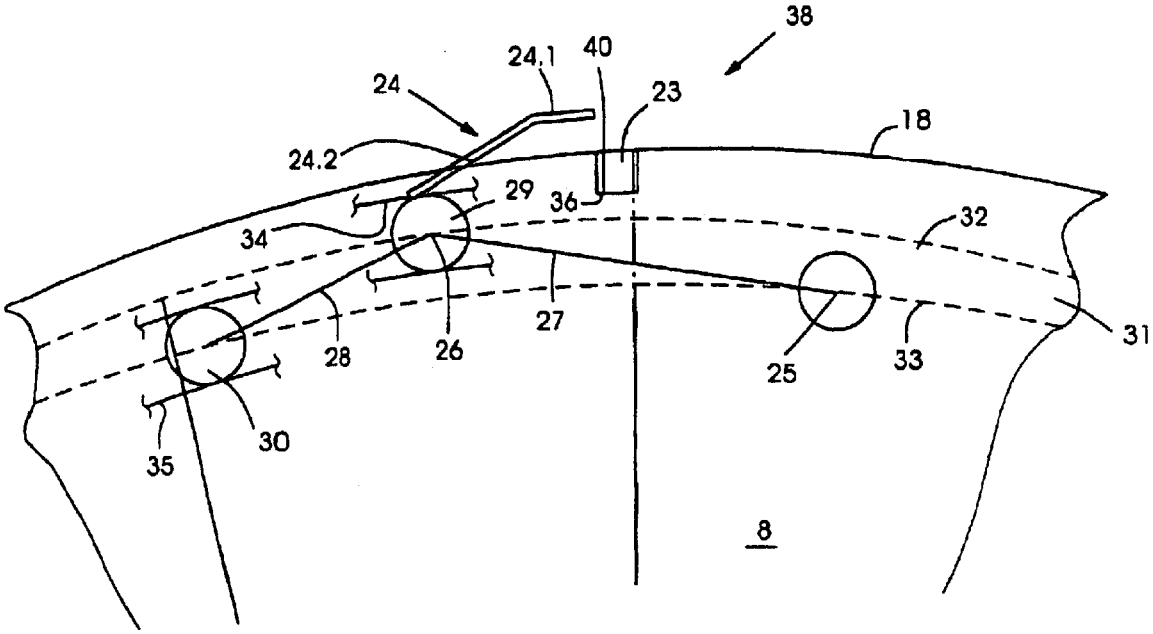

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–12, dependent on an amended claim, are determined to be patantable.

New claim 13 is added and determined to be patentable.

1. A paper conducting cylinder of a folder assembly comprising:

a cylinder surface having counterparts for cooperation with cutting elements of a cutting cylinder;

product seizing elements assigned located next to the counterparts on the cylinder surface;

a first actuating element *directly* connected to the product seizing elements;

a first linking member coupled to the first actuating element and to a first fixed pivot;

a second linking member; and a second actuating element coupled to the first actuating member via the second link member, the first actuating element following a first track and the second actuating member following a second track.

*13. A paper conducting cylinder of a folder assembly comprising:*

*a cylinder surface having counterparts for cooperation with cutting elements of a cutting cylinder;*

*product seizing elements assigned located next to the counterparts on the cylinder surface;*

*a first actuating element connected to the product seizing elements;*

*a first linking member coupled to the first actuating element and to a first fixed pivot;*

*a second linking member; and*

*a second actuating element coupled to the first actuating member via the second linking member, wherein the first actuating element connects the first linking member to the second linking member, the first actuating element following a first track and the second actuating member following a second track.*

* * * * *